United States Patent [19]
Nakamura

[11] Patent Number: 4,470,854
[45] Date of Patent: Sep. 11, 1984

[54] SURFACE HARDENING THERMAL TREATMENT

[75] Inventor: Kozo Nakamura, Hiratsuka, Japan

[73] Assignee: Kabushiki Kaisha Komatsu Seisakusho, Tokyo, Japan

[21] Appl. No.: 425,987

[22] Filed: Sep. 28, 1982

[30] Foreign Application Priority Data

Oct. 1, 1981 [JP] Japan ..... 56-154772
Oct. 1, 1981 [JP] Japan ..... 56-154773

[51] Int. Cl.³ ..... C21D 1/20; C21D 9/32
[52] U.S. Cl. ..... 148/16.5; 148/31.5; 148/39
[58] Field of Search ..... 148/15.5, 16.5, 16.6, 148/31.5, 36, 39, 12.4; 75/126 C, 128 W

[56] References Cited

U.S. PATENT DOCUMENTS

| | | | |
|---|---|---|---|
| 3,492,116 | 1/1970 | Kenneford et al. | 148/12.4 |
| 4,049,472 | 9/1977 | Arndt | 148/16.5 |
| 4,049,473 | 9/1977 | Davis et al. | 148/16.5 |
| 4,145,232 | 3/1979 | Solomon | 148/16.5 |
| 4,173,501 | 11/1979 | Hildebrandt et al. | 148/39 |
| 4,225,365 | 9/1980 | Rice | 148/36 |
| 4,406,714 | 9/1983 | Bowes et al. | 148/16.6 |

FOREIGN PATENT DOCUMENTS

| | | | |
|---|---|---|---|
| 10205 | 3/1972 | Japan | 148/16.6 |
| 10206 | 3/1972 | Japan | 148/16.6 |
| 84416 | 7/1981 | Japan | 148/16.6 |
| 119760 | 9/1981 | Japan | 75/126 C |
| 164917 | 10/1982 | Japan | 148/15.5 |
| 771173 | 10/1980 | U.S.S.R. | 148/16.6 |

OTHER PUBLICATIONS

Metals Handbook, Ninth Edition, "Carbonitriding", American Society for Metals, Metals Park, Ohio, 1981, pp. 176–190.

*Primary Examiner*—Peter K. Skiff
*Attorney, Agent, or Firm*—Armstrong, Nikaido, Marmelstein & Kubovcik

[57] ABSTRACT

A steel product, particularly a heavy-duty gear, having a case of martensite and a core of lower bainite with a Vickers hardness of not less than Hv 600 is obtained by subjecting a medium carbon alloy steel comprising, by weight, 0.45 to 0.60% C, up to 0.50 Si, 0.40 to 1.30% Mn, up to 4.00 Ni, 0.35 to 0.55% Cr, up to 0.70 Mo, balance Fe and incidental impurities to a carbonitriding treatment at a temperature of 800° to 900° C., austempering the carboritrided steel by quenching it in a hot bath of 230° to 300° C. and retaining the steel in the hot bath of the aforementioned temperature for a suitable duration enough to transform the core of the steel into lower bainite and not enough to cause any transformation of the case of the steel, and subsequently cooling the steel.

7 Claims, 5 Drawing Figures

SURFACE HARDENING THERMAL TREATMENT

BACKGROUND OF THE INVENTION

1. Field of the Invention

This invention relates to a method for surface hardening thermal treatment for steel, to medium carbon alloy steel to be used for the treatment, and to the steel to be produced by the aforementioned surface hardening thermal treatment.

2. Description of the Prior Art

Gears hardened by carburizing have high surface pressure strength and high bending fatigue strength and, therefore, find extensive utility in power lines of automobiles and construction machines. Since the carburizing of gears consumes much time and huge energy, the thermal treatment involved therein is expensive. Since the gears hardened by carburizing undergo heavy deformation during quenching, they are liable to pose problems such as noise and vibration. Not infrequently, therefore, the quenched gears are required to be finished by grinding.

In the circumstance, therefore, development of a method for surface hardening thermal treatment which, unlike the time-consuming treatment of carburizing described above, is capable of quickly producing gears possessing equal or even greater strength than carburized steel and entailing sparing quenching deformation has been in demand.

SUMMARY OF THE INVENTION

An object of this invention, therefore, is to provide a method for the surface hardening thermal treatment of steel, which by a treatment of very short duration as compared with the carburizing can confer ample surface hardness and excellent mechanical properties upon the steel under treatment and impart an ability to avoid undergoing heavy thermal deformation to the steel.

Another object of this invention is to provide steel which has undergone the surface hardening thermal treatment by the method of this invention and which, therefore, excels in mechanical properties such as surface hardness, fatique strength and toughness.

A further object of this invention is to provide a heavy-duty gear which has undergone the surface hardening thermal treatment by the method of this invention and which, therefore, excels in mechanical properties such as resistance to pitting, resistance to spalling and bending fatique strength.

Yet another object of this invention is to provide a medium carbon alloy steel which, in connection with the objects described above, possesses a specific composition such that the steel produced in consequence of the surface hardening thermal treatment by the method of this invention will manifest the excellent properties described above.

To accomplish the objects described above, according to this invention, there is provided a method for the surface hardening thermal treatment of steel, which comprises carbonitriding steel at a temperature of 800° to 900° C., then austempering the carbonitrided steel by quenching it in a hot bath of 230° to 300° C. and retaining the steel in the hot bath of the aforementioned temperature for a suitable duration enough to transform the core of the steel into lower bainite and not enough to cause any transformation of the case of the steel, and subsequently cooling the steel thereby producing steel having the case of martensite and the core of lower bainite. There are further provided, according to this invention, a medium carbon alloy steel which comprises, by weight, 0.45 to 0.60% C, up to 0.50% Si, 0.40 to 1.30% Mn, up to 4.00% Ni, 0.35 to 0.55% Cr, up to 0.70% Mo, balance Fe and incidental impurities and which is suitable for the surface hardening thermal treatment by the method described above, and steel which is produced by subjecting the medium carbon alloy steel of the aforementioned chemical composition to the aforementioned surface hardening thermal treatment and which, therefore, has the case of martensite texture and the core of lower bainite texture, and particularly a heavy-duty gear having the aforementioned textural structure.

DETAILED DESCRIPTION OF THE INVENTION

Figure 1:
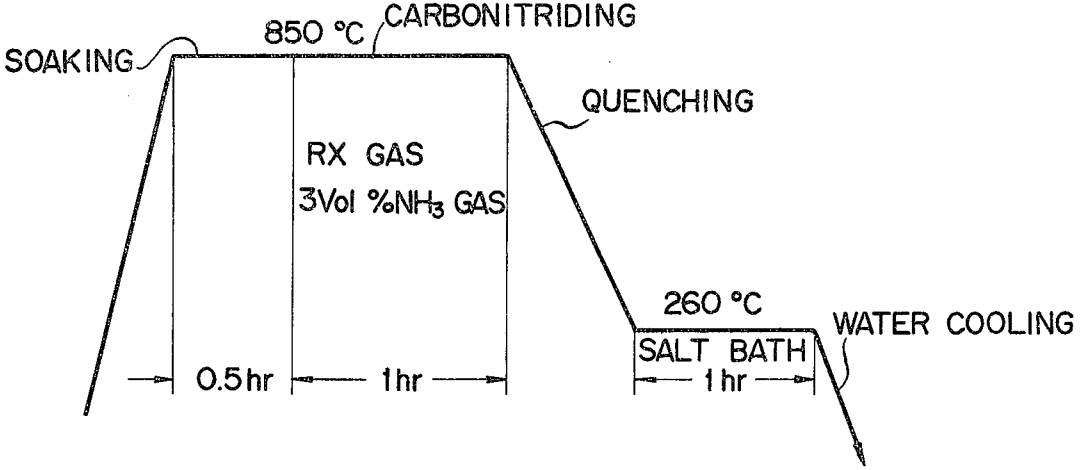
FIG. 1 is an explanatory diagram of the heat cycle involved in Example 1 embodying the method for the surface hardening thermal treatment according to this invention.

The method for the surface hardening thermal treatment of steel according to this invention is aimed at conferring a case of martensite and a core of lower bainite on steel by making use of the discrepancy between the bainite transformation starting points of the case and the core of steel as indicated in the TTT (time-temperature-transformation) diagram.

The method for the surface hardening thermal treatment of steel according to this invention will be described in detail below. First, steel is subjected to a carbonitriding treatment at a temperature of 800° to 900° C. to impregnate the case of steel with carbon and nitrogen. In the carbonitriding treatment, the steel is heated in an atmosphere obtained by adding ammonia gas to an endothermic gas consisting preponderantly of about 20% of CO, about 40% of $H_2$ and about 40% of $N_2$ (hereinafter referred to as "RX gas"). The proportion of the addition of ammonia gas to the endothermic gas may be changed in accordance with the content of nitrogen which the case of steel is desired to have in its finished state. Then, the steel which has undergone the carbonitriding treatment as described above is subjected to an austempering treatment in a hot bath such as salt bath whichis kept at a temperature of 200° to 300° C. The duration of this austempering treatment is fixed so that the core of steel will be completely transformed to lower bainite and the case of steel will not start undergoing transformation to lower bainite. By austempering the steel in the hot bath at the aforementioned temperature for the duration fixed as described above, the core of steel completely transforms into lower bainite and the case of steel remains a supercooled austenite texture.

When this particular textural structure is produced, the steel is cooled in air or in water. In consequence of this cooling, only the case of steel undergoes transformation into martensite and acquires high surface hardness and surface compression residual stress and the core of steel acquires a lower bainite texture with Vickers hardness of not less than Hv 600.

By combining the carbonitriding treatment with the aforementioned austempering treatment, the method for the surface hardening thermal treatment of the present invention gives rise to the discrepancy between the bainite transformation starting lines of the case and the core of steel and, thereby, conferring the case of martensite and the core of lower bainite on the steel.

When the surface hardening thermal treatment is carried out by the method of this invention as described above, the heat cycle of short duration enables the heavy-duty gear to derive an ability to resist pitting from the high martensite hardness of the case, an ability to resist spalling from the lower bainite hardness of not less than Hv 600 in the core, and bending fatique strength from the compressive residual stress in the case. The thermal treatment proceeds in the form of an austempering treatment in the core and a mar-quenching treatment in the case respectively. Thus the deformation by thermal treatment is less than half the thermal deformation involved in quenching.

Now, the method for the surface hardening thermal treatment according to this invention will be described more specifically below with reference to a working example. The working example is cited herein solely for the purpose of illustration of the invention and not in the least for the purpose of limiting the invention in any respect. Example:

A medium carbon alloy steel composed of 0.55% C, 0.25% Si, 0.70% Mn, 1.82% Ni, 0.51% Cr, 0.18% Mo, and the balance to make up 100% of Fe was subjected to a surface hardening thermal treatment in accordance with the method of the present invention.

Figure 2:
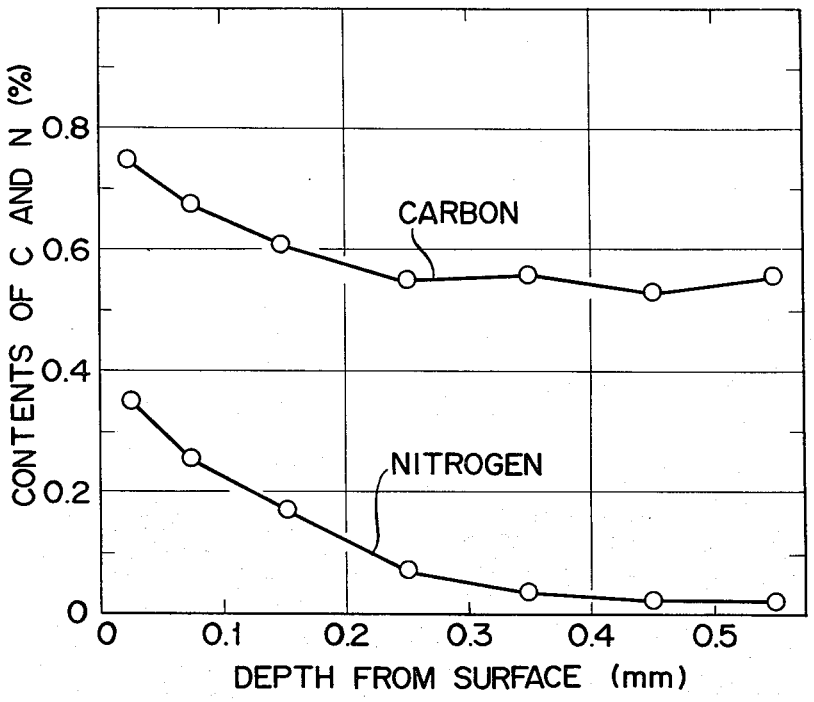
FIG. 2 is a diagram showing the distribution of carbon and nitrogen contents in steel after carbonitriding treatment.

The heat cycle involved in this treatment was as shown in FIG. 1. First, the steel was carbonitrided at 850° C. for 1 hour. The atmosphere enveloping the site of treatment was a RX gas (endothermic gas) containing 3% by volume of ammonia gas. The steel which had acquired a distribution of carbon and nitrogen contents as shown in FIG. 2 in consequence of the carbonitriding treatment was plunged into a niter type salt bath at 260° C. and kept at the same temperature for 1 hour.

Figure 3:
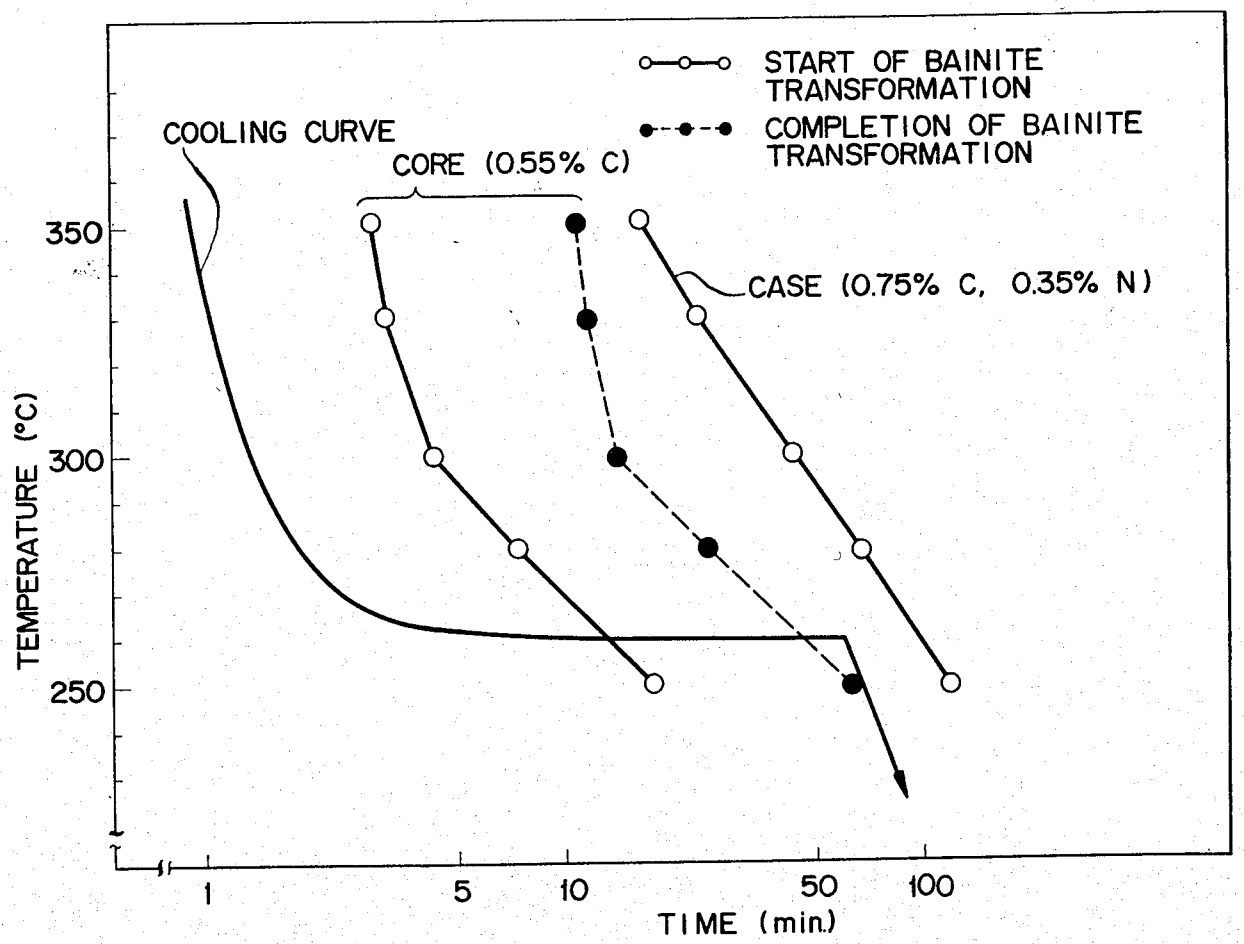
FIG. 3 is a time-temperature-transformation (TTT) diagram showing the core and the surface carbonitrided layer of a sample steel.

A TTT diagram was obtained of the core and the carbonitrided case of the sample steel which had undergone the carbonitriding treatment and the austempering treatment as described above. This diagram is shown in FIG. 3. It is noted from FIG. 3 that, in consequence of the austempering treatment effected by keeping the steel at 260° C. for 1 hour, the core was completely transformed into lower bainite and the case remained a supercooled austenite texture. When the steel was cooled in air or in water after it has assumed the textural structure just mentioned, the surface layer alone started transforming into martensite to acquire high surface hardness and large compressive residual stress and the core assumed high hardness of not less than Hv 600.

Figure 4:
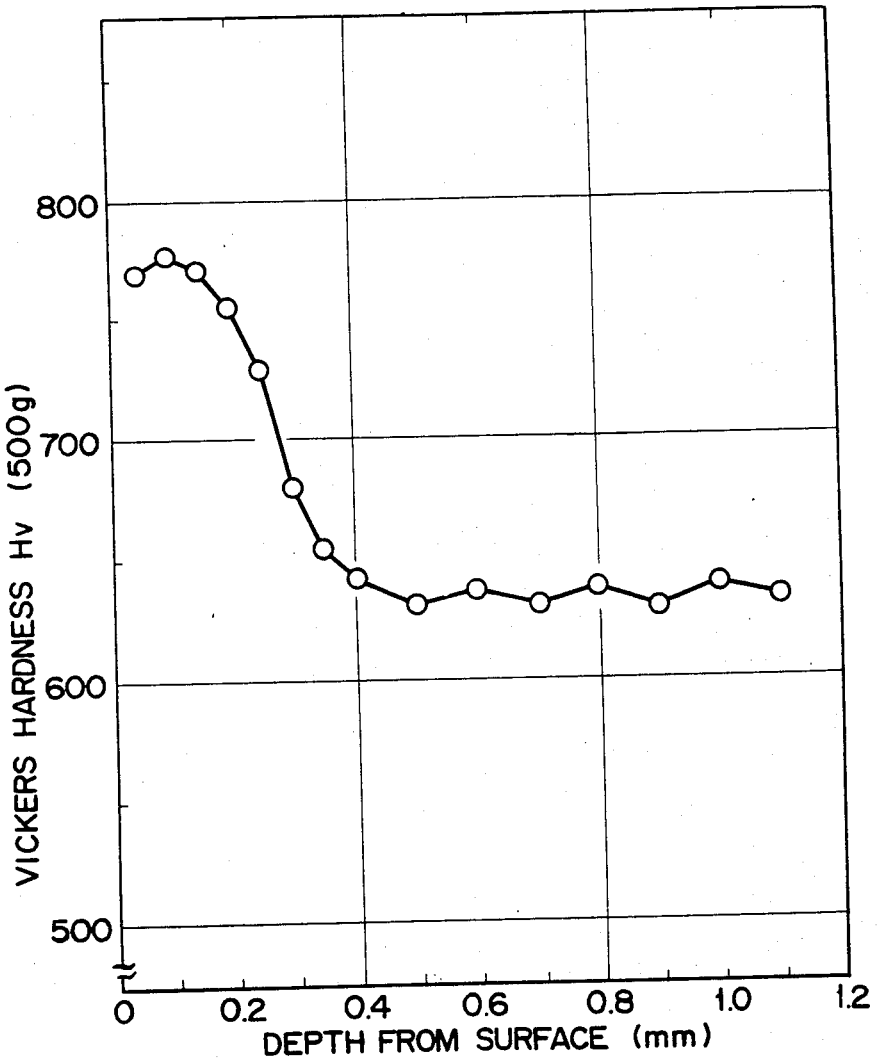
FIG. 4 is a diagram showing the cross-sectional distribution of hardness of the steel after the surface hardening thermal treatment.

FIG. 4 represents the cross-sectional distribution of hardness of the sample steel which had undergone the aforementioned surface hardening thermal treatment.

Figure 5:
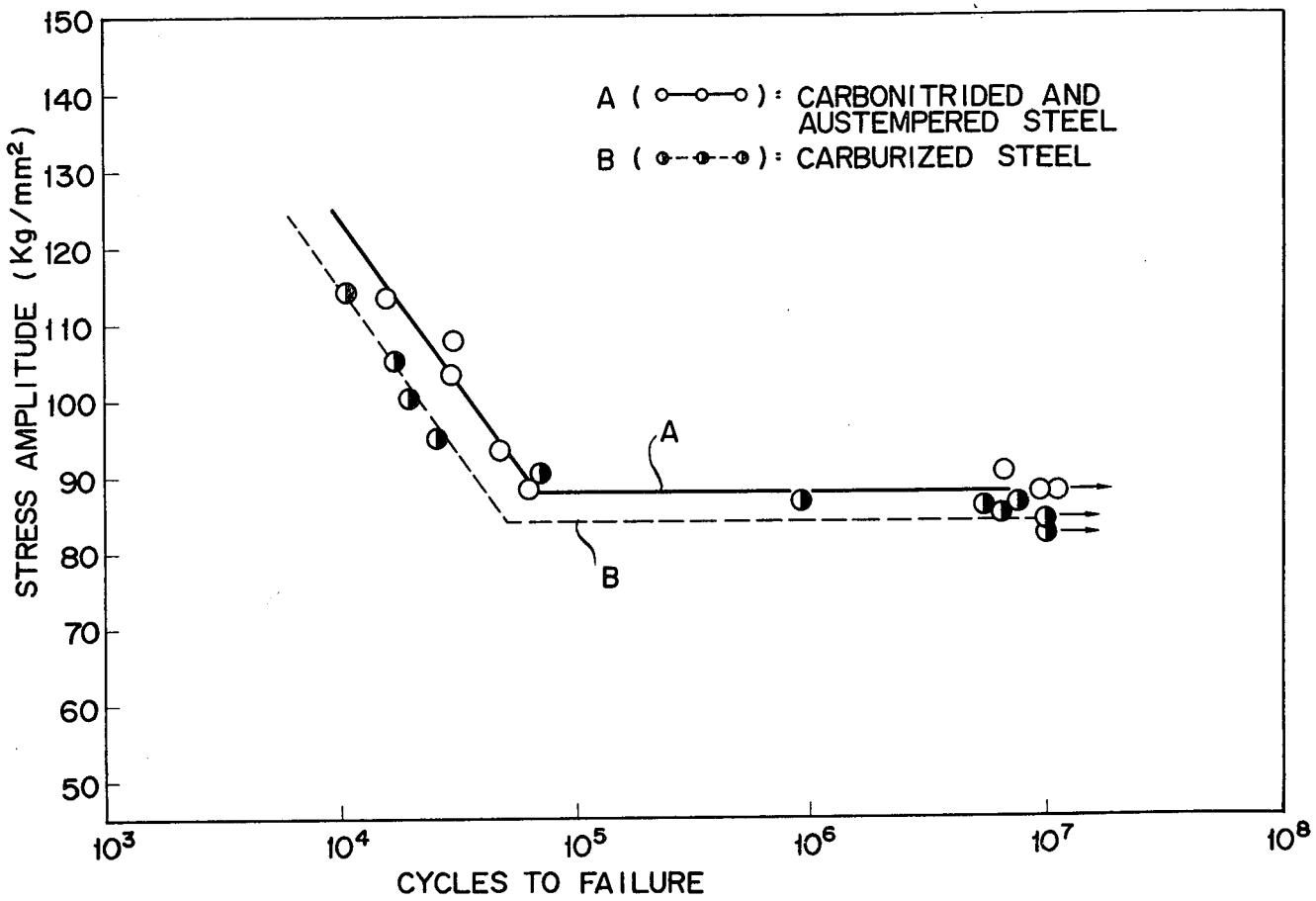
FIG. 5 is an S-N diagram showing the results of the rotary bending fatique test conducted on a smooth test piece 9 mm in diameter.

Then a smooth test piece 9 mm in diameter was cut from the sample steel which had undergone the surface hardening thermal treatment as described above was tested for rotary bending fatique. The S-N diagram obtained of the results of this test is shown in FIG. 5 (curve A in the graph). The results obtained similarly of carburized steel (JIS SCM 415 H, carburized at 930° C. for 7 hours) are also shown (curve B in the graph). The two test pieces exhibited substantially equal levels of fatique strength.

Separately a gear was manufactured from a medium carbon alloy steel of the same chemical composition as described above. It was subjected to the same surface hardening thermal treatment and then tested for pitting fatigue strength. For the purpose of comparison, a gear manufactured from carburized steel was similarly tested.

| Gear Test | |
|---|---|
| Test conditions: | |
| Testing machine | Powered circulation type gear tester |
| Contact pressure | 130 kg/mm$^2$ |
| Number of revolutions | 2200 rpm (pinion) |
| Lubrication | Engine oil #30, 80° C., 1.2 liters/min. |
| Gear | $m = 4.5$, $\alpha = 20°$, $Z_1 = 16$, $Z_2 = 24$ |

The results of the gear test are shown in Table 1 below.

TABLE 1

| Type of surface hardening thermal treatment of gear | Number of contacts before occurrence of pitting (average for n = 4) |
|---|---|
| Same as in Example | $6.2 \times 10^7$ |
| Carburizing* | $5.1 \times 10^7$ |

*The carburized steel was obtained by subjecting steel of JIS SCM 415H to a carburizing treatment at 930° C. for 7 hours. The depth of carburizing was 1.0 mm.

It is noted from the test results shown above that one hour of carbonitriding treatment performed in accordance with the method of this invention gave greater strength to the gear than 7 hours of carburizing. This fact indicates that the method of this invention affords a substantial reduction in the heat cycle.

Then, the conditions for the surface hardening thermal treatment according to the present invention will be described below.

Carbonitriding treatment:

This invention resides in utilizing the discrepancy between the bainite transformation starting lines of the case and the core of steel in the TTT diagram. It is, therefore, required to widen this discrepancy amply. In order that the core of steel may acquire sufficiently high bainite hardness exceeding the level of Hv 600, it is necessary to increase the carbon content in the core beyond 0.45%. Moreover, when the steel which has such a high carbon content in its core is carburized, no amply wide discrepancy can be produced between the bainite transformation starting times because the difference of carbon content between the case and the core is small. To widen this discrepancy, it becomes necessary to perform the carbonitriding treatment to add nitrogen as well as carbon to the case of steel so that the effect of nitrogen may be utilized to advantage. When the temperature of the carbonitriding treatment exceeds 900° C., the nitrogen content in the case cannot be heightened as expected. When it falls short of reaching 800° C., the hardenability of steel is impaired because the core fails to assume uniform austenite texture. Hence, the carbonitriding treatment should be carried out at a temperature in the range of 800° to 900° C.

Austempering treatment:

When the temperature of the hot bath for the austempering treatment exceeds 300° C., it is no longer possible to give the core of steel ample hardness exceeding Hv 600. When the temperature is less than 230° C., the isothermal retention of steel in the hot bath is required to last for a long time to ensure transformation of the core of steel into lower bainite. An increase in the duration of isothermal retention results in a loss of productivity of the treatment. Hence, the austempering treatment should be carried out at a temperature in the range of 230° to 300° C.

Duration of austempering treatment:

The duration of the austempering treatment is required to be enough for at least 80% by volume of the core of steel to be transformed into lower bainite. This is because the steel acquires insufficient toughness when the treatment produces a mixed texture of bainite with a large amount of martensite or residual austenite. Further, the duration of the austempering treatment should be short enough so that the treatment terminates before the case begins to transform into bainite. Hence, the duration of the austempering treatment should be enough for at least 80% by volume of the core to be transformed into bainite and not enough for the case of steel to start transforming into bainite at the given temperature.

Such a proper duration of the austempering treatment is variable with the composition of steel and with the temperature of the austempering treatment. Table 2 given below shows the relation between the temperature and the duration of austempering treatment determined of the three types of steel, A through C.

Type of steel:

(A) Steel composed of 0.55% C, 0.25% Si, 0.70% Mn, 1.82% Ni, 0.51% Cr, 0.18% Mo, balance Fe and impurities.

(B) Steel composed of 0.54% C, 0.28% Si, 1.20% Mn, 0.04% Ni, 0.49% Cr, 0.19% Mo, balance Fe and impurities.

(C) Steel composed of 0.57% C, 0.21% Si, 0.80% Mn, 1.50% Ni, 0.50% Cr, 0.46% Mo, balance Fe and impurities.

TABLE 2

| Temperature of austempering treatment (°C.) | Proper duration of austempering time (min.) | | |
|---|---|---|---|
| | Steel A | Steel B | Steel C |
| 240 | 100–120 | 90–110 | 150–170 |
| 260 | 60–80 | 50–60 | 90–110 |
| 280 | 40–55 | 30–35 | 60–80 |
| 300 | 20–30 | 17–22 | 30–40 |

For the reasons given below, the steel to be subjected to the surface hardening thermal treatment by the method of this invention is desired to have a specific chemical composition to be described afterward.

The steel on which the surface hardening thermal treatment of this invention is carried out is required to possess ample hardenability so that it will produce neither pearlite nor upper bainite while it is being quenched in the hot bath.

The surface hardening thermal treatment of the present invention is characterized by utilizing the discrepancy between the bainite transformation starting lines of the core of steel and the carbonitrided case of steel. This discrepancy, therefore, is required to be ample. In this sense, the carbon content in the core is desired to be as low as permissible. On the other hand, for the purpose of giving high hardness to the core, the carbon content is desired to be as high as permissible. Hence, the carbon content is inevitably defined in a specific range.

In view of the various conditions described above, it is inevitable that the composition of the steel should be defined. Now, therefore, the reasons for the limits fixed for the components of steel will be described below.

Concerning carbon (C), the lower bainite hardness of the core of steel increases in proportion as the carbon content increases and the temperature of the austempering treatment falls. When the carbon content is lowered, the temperature of the austempering treatment can no longer be lowered because the lowered carbon content lowers the hardness and, at the same time, heightenes the Ms point. No sufficient hardness of the core is obtained for the two reasons given above. Hence, the carbon content should be at least 0.45%, the very lower limit at which the core acquires hardness of at least Hv 600. When the carbon content exceeds 0.60%, the discrepancy between the bainite transformation starting lines of the core and the case of steel is too narrow to produce the textural structure aimed at by the present invention.

Hence, the carbon content is defined in the range of 0.45 to 0.60%.

Concerning silicon (Si), when it is contained excessively, excess silicon is combined with the nitrogen atoms in the carbonitrided layer to form a nitride ($Si_3N_4$) while the steel is being quenched in the hot bath and while it is undergoing the austempering treatment. Since this nitride has an effect of advancing the time for starting the bainite transformation of the carbonitrided layer. Hence, the silicon content is required to be maintained at a level equal to or below 0.50%.

Manganese (Mn) is an element which is effective in enhancing the bainite strength and heightening the hardenability of steel. When the manganese content exceeds 1.30%, however, the machinability of steel sharply declines. Similarly to silicon, excess manganese is combined with the nitrogen atoms in the carbonitrided layer to form a nitride ($Mn_4N$) while the steel is being quenched in the hot bath and while it is undergoing the austempering treatment. This nitride also has an effect of advancing the time for starting the bainite transformation. Thus, the manganese content is required to be maintained at a level equal to or below 1.30%. When the manganese content is below 0.40%, it fails to effect sufficient deoxidization and encourages the toxicity of sulfur (S). Thus, the manganese content is required to be kept from falling below 0.40%. Hence, the manganese content is defined in the range of 0.40 to 1.30%.

Nickel (Ni) is an element which is effective in heightening the strength, toughness and hardenability of steel. When the nickel content exceeds 4.00%, the effect of this element in improving the hardenability of steel is substantially saturated and the duration of the austempering treatment required for completion of bainite transformation of the core is lengthened. Hence, the nickel content is required to be kept at a level equal to or below 4.00%.

Chromium (Cr) is an element which is effective in heightening the hardenability of steel. When the chromium content exceeds 0.55%, however, excess chromium is quite liable to be combined with the nitrogen atoms in the carbonitrided layer to form a nitride ($Cr_2N$) while the steel is being quenched in the hot bath and while it is undergoing the austempering treatment. This nitride has an undesirable effect of impairing the hardenability of the carbonitrided layer and advancing the time for starting the bainite transformation. Thus, the chromium content is required to be kept from exceeding 0.55%. Similarly to molybdenum (Mo), chromium is particularly effective in enhancing the hardenability of steel when the carbon content is in the range of 0.45 to 0.60% as in the steel of this invention. Thus, chromium should be added in an amount of at least 0.35%. Hence, the chromium content is defined in the range of 0.35 to 0.55%.

Molybdenum (Mo) is quite effective in enhancing the hardenability of steel when the carbon content is in the range contemplated by this invention. When the molybdenum content exceeds 0.70%, however, the duration of the austempering treatment requied for completion of the bainite transformation of the core of steel is lengthened. Hence, the molybdenum content is required to be ket at a level equal to or below 0.70%.

For the various reasons given above, therefore, the steel on which the surface hardening thermal treatment of the present invention can be advantageously carried out should be composed of 0.45 to 0.60% C, up to 0.50% Si, 0.40 to 1.30% Mn, up 4.00% Ni, 0.35 to 0.55% Cr, up to 0.70% Mo, and the balance to make up 100% of Fe and impurities.

By adjusting the composition of the components within the ranges mentioned above to suit the hardenability of steel due to its mass, there can be obtained a textural structure aimed at by the carbonitriding plus austempering treatment.

The aforementioned medium carbon alloy steel acquires a textural structure having the case of martensite and the core of lower bainite only when the steel is subjected to the surface hardening thermal treatment in accordance with the method of this invention.

The medium carbon alloy steel which has undergone the surface hardening thermal treatment, therefore, acquires an ability to resist pitting from the high martensite hardness of the case, an ability to resist spalling from the hardness of the core, and bending fatique strength from the compressive residual stress of the case. Moreover, this steel entails sparing deformation by thermal treatment. Thus, this steel can be advantageously used for the production of heavy-duty gears such as transmission gears and final reduction gears in bulldozers, power shovels and dump trucks, for example.

What I claim is:

1. A method for the surface hardening thermal treatment of steel having a carbon content of 0.45 to 0.60%, which comprises:

carbonitriding steel at a temperature of 800° C. to 900° C., austempering carbonitrided steel by quenching it in a hot bath at a temperature of 230° to 300° C. and retaining the steel in a hot bath at said temperature for a suitable duration enough to transform the core of said steel into lower bainite and not enough to cause any transformation of the case of said steel, and subsequently cooling said steel thereby producing steel having the case of martensite and the core of lower bainite, said lower bainite of said core having a Vickers hardness of not less than 600 Hv.

2. The method according to claim 1, wherein said carbonitriding treatment is carried out in an atmosphere obtained by adding ammonia gas to an endothermic gas consisting preponderantly of about 20% of CO, about 40% of $H_2$, and about 40% of $N_2$.

3. The method according to claim 2, wherein said ammonia gas is added in an amount of 3% by volume.

4. The method according to claim 1, wherein the duration of said austempering treatment is in the range of 20 to 170 minutes.

5. The method of claim 1, wherein the composition of the steel, by weight, is 0.45 to 0.60% C, up to 0.50% Si, 0.40 to 1.30% Mn, up to 4.00% Ni, 0.35 to 0.55% Cr, up to 0.70% Mo, balance Fe and incidental impurities.

6. A steel product comprising, by weight, 0.45 to 0.60% C, up to 0.50% Si, 0.40 to 1.30% Mn, up to 4.00% Ni, 0.35 to 0.55% Cr, up to 0.70% Mo, balance Fe and incidental impurities, said product having a case of matensite and a core of lower bainite, the carbon and nitrogen content of said case being higher than that of said core due to carbonitriding the steel, and said lower bainite of said core having a Vickers hardness of not less than Hv 600.00.

7. The steel product according to claim 6, which product is a heavy-duty gear.

* * * * *